US008567986B2

(12) United States Patent
Szprengiel et al.

(10) Patent No.: US 8,567,986 B2
(45) Date of Patent: Oct. 29, 2013

(54) SELF-CONTAINED LED TUBULAR LUMINAIRE

(75) Inventors: Stanley Szprengiel, Jackson, NJ (US); Thomas Graham, Ocean, NJ (US); Viranjitsinh Chudasama, Freehold, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 0 days.

(21) Appl. No.: 13/065,387

(22) Filed: Mar. 21, 2011

(65) Prior Publication Data

US 2012/0243217 A1 Sep. 27, 2012

(51) Int. Cl.
*F21V 21/00* (2006.01)

(52) U.S. Cl.
USPC ..... 362/217.01; 362/217.12; 362/249.01; 362/249.02; 362/368

(58) Field of Classification Search
USPC ..... 362/217.01, 217.12, 217.13, 217.17, 362/219, 223, 225, 235, 240, 244, 246, 362/249.01, 249.02, 249.11, 311.02, 368, 362/545, 555, 581, 800
See application file for complete search history.

(56) References Cited

U.S. PATENT DOCUMENTS

| | | | | |
|---|---|---|---|---|
| 6,609,813 | B1 * | 8/2003 | Showers et al. | 362/240 |
| 6,776,504 | B2 * | 8/2004 | Sloan et al. | 362/240 |
| 6,882,111 | B2 * | 4/2005 | Kan et al. | 315/122 |
| 7,088,904 | B2 * | 8/2006 | Ryan, Jr. | 385/147 |
| 7,159,997 | B2 * | 1/2007 | Reo et al. | 362/240 |
| 7,192,161 | B1 * | 3/2007 | Cleaver et al. | 362/260 |
| 7,331,689 | B2 * | 2/2008 | Chen | 362/240 |
| 8,072,124 | B2 * | 12/2011 | Liu et al. | 313/46 |
| 8,104,920 | B2 * | 1/2012 | Dubord | 362/217.12 |
| 2002/0044456 | A1 * | 4/2002 | Balestriero et al. | 362/555 |
| 2011/0122623 | A1 * | 5/2011 | Miura | 362/249.02 |

* cited by examiner

*Primary Examiner* — Hargobind S Sawhney
(74) *Attorney, Agent, or Firm* — Francis C. Hand; Carella, Byrn, et al.

(57) ABSTRACT

The LED tube for a lighting fixture has a transparent peripheral portion, internally disposed grooves for receiving an LED array board opposite the transparent portion and externally disposed longitudinally extending slots to slidably receive connectors for the mounting of the fixture. Multiple tubes can be grouped together in arrays of two or more without requiring different fixture enclosures.

7 Claims, 5 Drawing Sheets

SELF-CONTAINED LED TUBULAR LUMINAIRE

This invention relates to a self-contained LED tubular luminaire.

Many types of lighting fixtures have been known that employ different lighting sources, such as, incandescent light bulbs, fluorescent light tubes and light emitting diodes (LEDs). In particular, U.S. Pat. No. 6,213,622 describes the use of LEDs for a stair lighting system. Published US Patent Application 2010/0214770 describes a combination LED fixture and raceway for use under a cabinet.

It is an object of this invention to provide an improved construction of an LED tube that can stand alone without a fixture.

It is another object of the invention to provide an LED tube that is adaptable to many varied types of mounting configurations, It is another object of the invention to provide a plurality of LED tubes that can be ganged together either width-wise or length-wise to give more light and which contain a plug and socket connection to a supply mains for easy replacement.

Briefly, the invention provides an LED tube having a transparent lens portion and an opaque portion secured to the transparent lens portion. The tube is characterized in being self-supporting.

The transparent lens portion of the LED tube is provided with a pair of internally disposed grooves in which an LED array board can be mounted across the inside of the tube in opposition to the transparent portion for emitting light through the transparent lens portion of the tube.

The opaque portion of the LED tube is provided with a pair of internally disposed grooves in which a circuit board containing driver circuitry can be mounted inside the tube behind the LED array board relative to the transparent lens portion. A space is also provided behind the circuit board to allow a "pass-through" cable to carry the mains power from a male power inlet connector at one end of the tube through to a mating female connector at the other end of the tube.

Further, the LED tube may be provided with a proper socket and with a driver circuitry sealed within so that the tube can simply be unplugged for replacement by routine maintenance personnel rather than by a licensed electrician.

The opaque portion of the LED tube is also provided with a pair of externally disposed grooves for slidably receiving a pair of connectors. Each connector, in turn, slidably receives a mounting bracket for mounting of the tube in a suitable piece of equipment or other suitable device requiring illumination.

The LED tube is made strong enough to serve as its own fixture. There is no fragile glass tube to break and no delicate pins or "tombstone" sockets to be damaged. Thus, no protective lens is required and no high voltage ballast that needs to be protectively enclosed to meet safety standards is required. Similarly, no grounded metal enclosure is required.

The LED tube may replace a fluorescent tube in an existing fixture to save energy. Due to the much longer life of LED tubes versus fluorescent tubes, the tube need not be as readily accessible to permit quick tube changes as have been previous fixtures. Also, since LED tubes do not fail as suddenly as fluorescent tubes, but rather fail LED by LED giving a gradual diminishing of total brightness, the LED tube can thus be scheduled for replacement at a future date as schedules permit. As a result, the tube can be designed to be less readily accessible for quick tube changes as previous ones have been, resulting in great cost savings.

If more than one tube is required to give sufficient illumination, two or more tubes can be connected in series by a wire connector. The tubes may be structurally connected widthwise in parallel or length-wise in series.

These and other objects and advantages of the invention will become more apparent from the following detailed description taken in conjunction with the accompanying drawings wherein.

Figure 1:
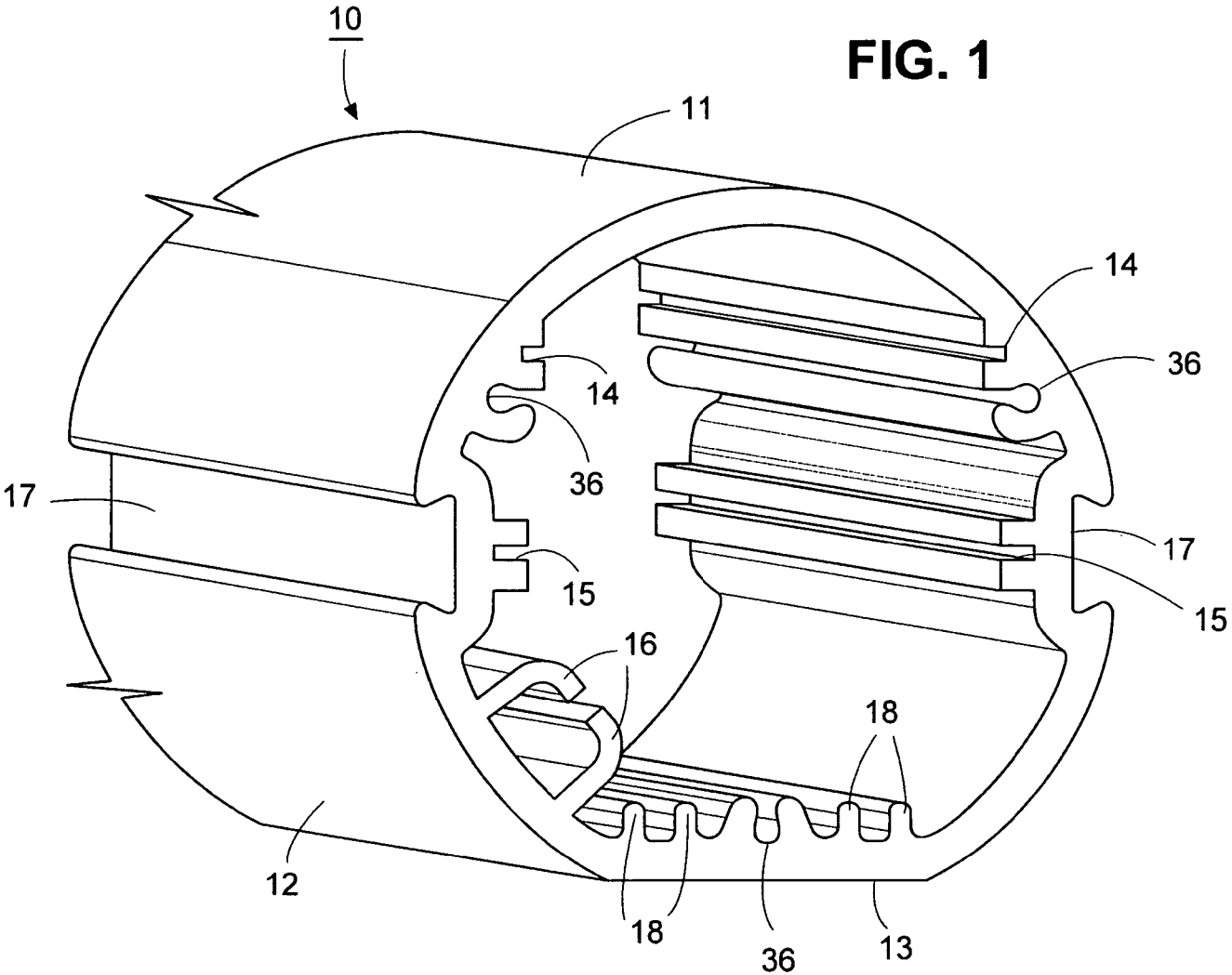
FIG. 1 illustrates a perspective view of an LED tube in accordance with the invention.

Referring to FIG. 1, the LED tube 10 is made as a two-part plastic extrusion, or as a co-extrusion, consisting of a transparent lens portion 11 and an opaque portion 12 fused, integrally extruded, or fastened to the transparent portion 11 permanently with a suitable adhesive. As illustrated, the transparent lens portion 12 is at the top of the tube 10 and extends over the entire length of the tube 10. The opaque portion 12 is provided with a flat surface 13 for ease of assembly of components within the tube 10.

The transparent lens portion 11 and opaque portion 12 are integral with each other to form a self-supporting tubular body.

The transparent lens portion 11 is made of transparent polycarbonate with an UL Flame Rating of UL 94-5VA.

The opaque portion 12 is made of nontransparent polycarbonate with an UL Flame Rating of UL 94-5VA.

The LED tube 10 has a pair of longitudinally extending slots 14 integrally formed inside the transparent portion 11 and a second pair of longitudinally extending slots 15 and a pair of tabs 16 integrally formed in the opaque portion 12. The first pair of slots 14 serves to carry an LED board (not shown) in proper positioning relative to the transparent lens portion 11. The second pair of slots 15 is located below and behind the first pair of slots 14, as viewed, to carry a circuit board (not shown) containing a driver circuitry. The pair of tabs 16 is located to one side under the slots 15, as viewed, to form a space for a "pass-through" cable (not shown) to carry the mains power from a male power inlet connector (not shown) at the one end of the tube 10 through to the other end of the tube 10 where a mating female connector (not shown) is attached.

This opaque portion 12 is sufficiently sized to permit one or more longitudinally extending female "dovetail" slots 17 to be incorporated externally of the tube 10, one on 0each side of the tube 10, for mounting purposes. Each slot 17 extends over the entire length of the tube 10. As illustrated, each slot 17 is co-planar with the slots 15 for the circuit board.

The interior of the tube 10 may also be provided with longitudinally extending stiffening ribs 18 opposite the flat surface 13 to provide rigidity to the tube 10.

Figure 2:
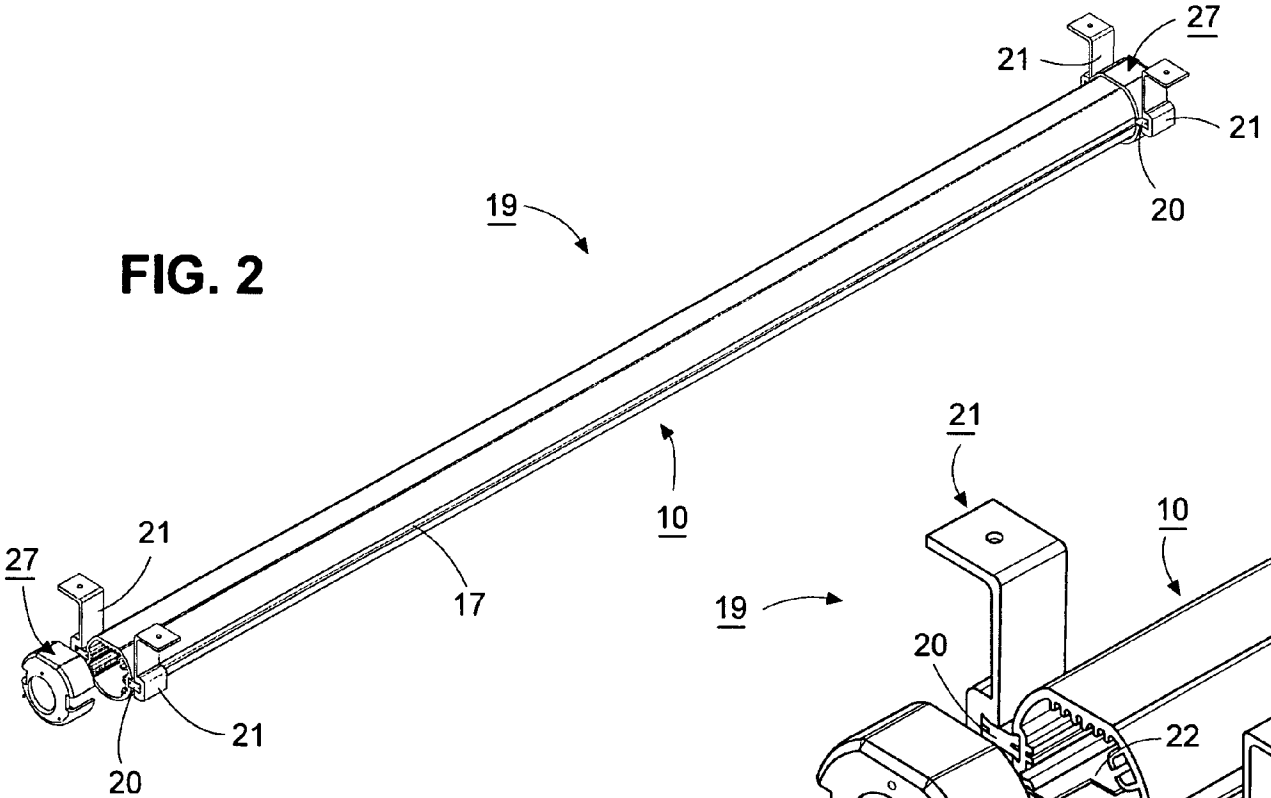
FIG. 2 illustrates a lighting fixture incorporating the tube of FIG. 1.

Referring to FIG. 2, wherein like reference characters indicate like parts as above, the lighting fixture 19 includes a tube 10, as above, and a pair of mounting means at each end of the tube 10.

Figure 3:
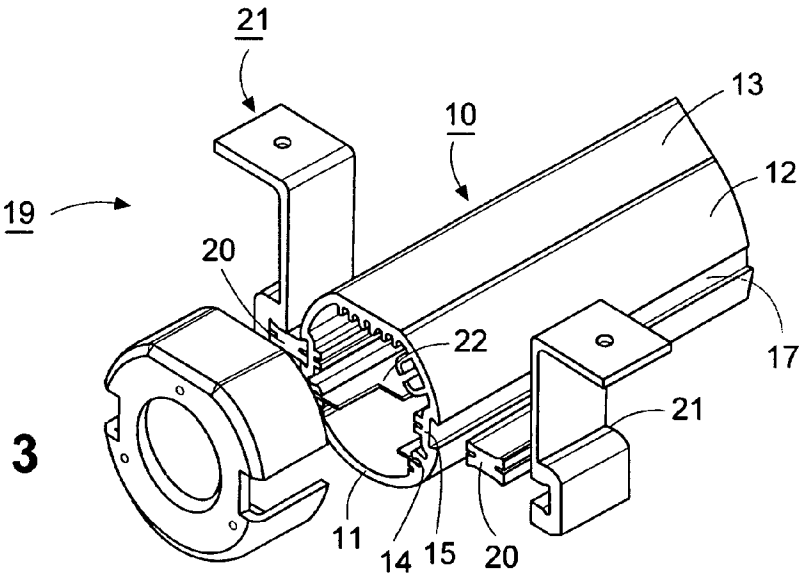
FIG. 3 illustrates an exploded view of one end of the lighting fixture of FIG. 2.

Referring to FIGS. 2 and 3, each mounting means is in the form of pairs of connectors 20 and pairs of mounting brackets 21 for mounting the tube 10 in or on a device requiring illumination. As illustrated, the tube 10 is positioned with the transparent portion 11 facing downwardly and as mounting an LED board 22 with a linear array of LED's (not shown) in the slots 14.

Figure 4:
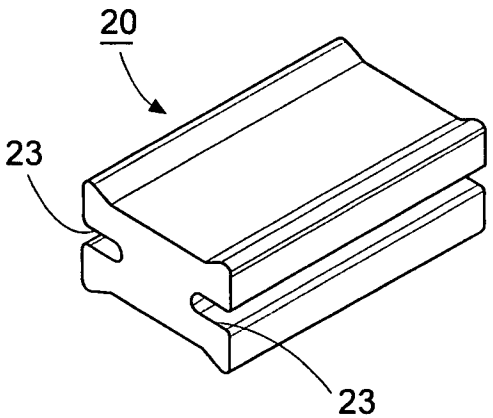
FIG. 4 illustrates a perspective view of a connector employed in the fixture of FIG. 2.

Referring to FIGS. 3 and 4, each connector 20 is of a shorter length than the tube 10 so as to be slid along the length of the tube 10 from either end to a suitable mounting position. Each connector 20 has a dovetail shape on each of two sides to mate within the dovetail shaped slots 17 of the tube 10 in sliding relation. In addition, each side of the connector 20 is provided with a slot 23 to provide a degree of resiliency to the side of the connector 20 for fitting into a dovetail slot 17 of the tube 10.

The number of connectors 20 is variable as needed for the length of the tube 10 and the number of attaching points desired. Since the connectors 20 can be slid along the dovetail slots 17 of the tube 10, the connectors 20 can be positioned, for example, to accommodate support stud spacing in various types of ceilings.

Each connector is made of plastic with an UL Flame Rating of UL 94-5VA or is made of metal.

Figure 5:
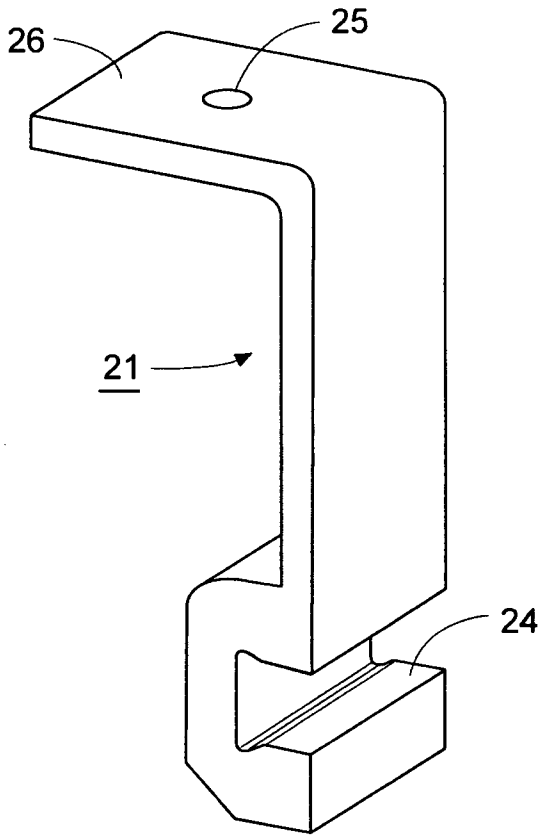
FIG. 5 illustrates a perspective view of a mounting bracket employed with the fixture of FIG. 2.

Referring to FIGS. 3 and 5, each mounting bracket 21 is an aluminum extrusion section of L-shaped cross-section that carries a dovetail groove 24 at the end. As illustrated, each groove 24 is identical to a dovetail slot 17 in the opaque portion 12 of the tube 10 and is sized to slidingly receive one side of a connector 20 in a similar manner. Each mounting bracket 21 also has one or more mounting holes 25 in an upper leg 26 for a fastening screw (not shown).

As illustrated, the legs 26 of the mounting brackets 21 are flat and co-planar with each other for mounting against a flat surface of a cabinet or any structure that requires a lighting fixture. The legs 26 of the mounting brackets 21 may be of any suitable shape to allow for mounting on non-flat surfaces. The legs 26 may also be co-planar with the flat surface 13 of the tube 10 or non-co-planar to allow a space between the tube 10 and the structure on which the fixture 19 is mounted.

Referring to FIG. 3, the lighting fixture 19 also has an end cap 27 at each end (only one of which is shown) for closing off the tube 10. Each end cap 27 has a base 28 and a circular wall 29 extending from the base 28 to define a cup shape to fit over the end of the tube 10. In addition, each cap 27 has a pair of cut-outs 30 at opposite sides to coaxially align with the dovetail slots 17 in the outside of the tube 10. These cut-outs 30 allow the connectors 20 to be attached without need to remove the end cap 27 from the tube 10.

Figure 6:
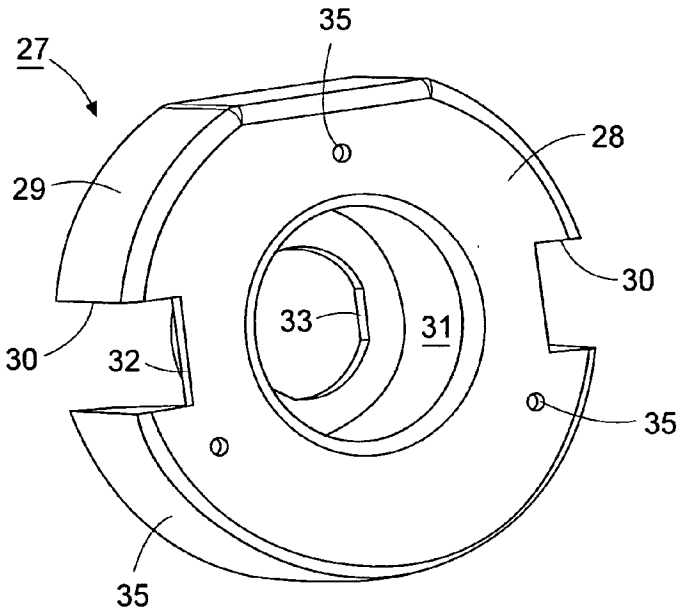
FIG. 6 illustrates a perspective view of an end cap employed with the fixture of FIG. 2.

Referring to FIG. 6, each end cap 27 has an opening 31 in the base 28, an inner wall 32 concentric to the outer wall 29 and an inwardly directed flange 33 at the end of the inner wall 32 to define a space. This space is sized to receive a male or female wire connector 34 (see FIG. 8) to enable the connection of multiple tubes 10 together.

Referring to FIG. 3, each end cap 27 has a plurality of holes 35, for example, three, that are aligned with mounting ears or grooves 36 formed internally of the tube 10 so that mounting screws (not shown) may be passed through to secure the end cap 27 to the end of the tube 10.

The LED board 22 that is mounted in the lighting fixture 19 is of conventional construction having a plurality of light emitting diodes (LEDs) disposed in a linear array. Preferably, the LED board 22 is slid into the grooves 14 of the tube 10 during assembly and before the end caps 27 are mounted in place.

Likewise, the circuit board (not shown) is of conventional structure and is slid into the grooves 15 of the tube 10 before the end caps 27 are mounted in place.

With the LED array (not shown) in place, the transparent lens portion 11 of the tube 10 protects the LEDs yet still permits light from the LED array to exit. The opaque portion 12 serves to encase the electronics as well as to give rigidity to the entire construction.

With "pass-through" wiring and sockets as described above, if more than one tube 10 is needed to give sufficient illumination, two or more tubes 10 can be assembled parallel to one another by using one or more male dovetail connectors 20, each fitting one male protrusion in a left side dovetail slot 17 of one tube 10 and one male protrusion in a right side dovetail slot 17 of the other tube 10. This permits the tubes 10 to be easily grouped together in arrays of two or more without requiring different fixture enclosures or housings, as is the case with traditional fixture construction.

Figure 9:
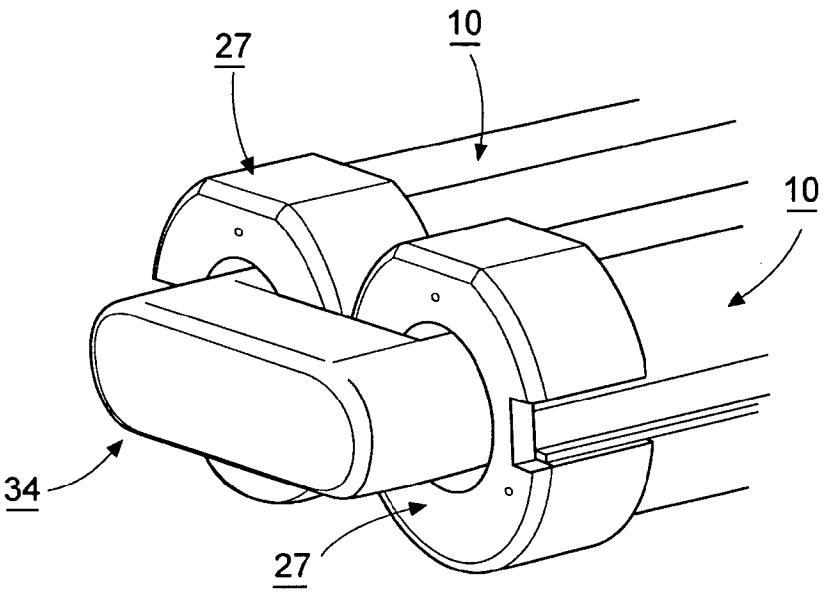
FIG. 9 illustrates a perspective view of the wire connector of FIG. 8.
Figure 8:
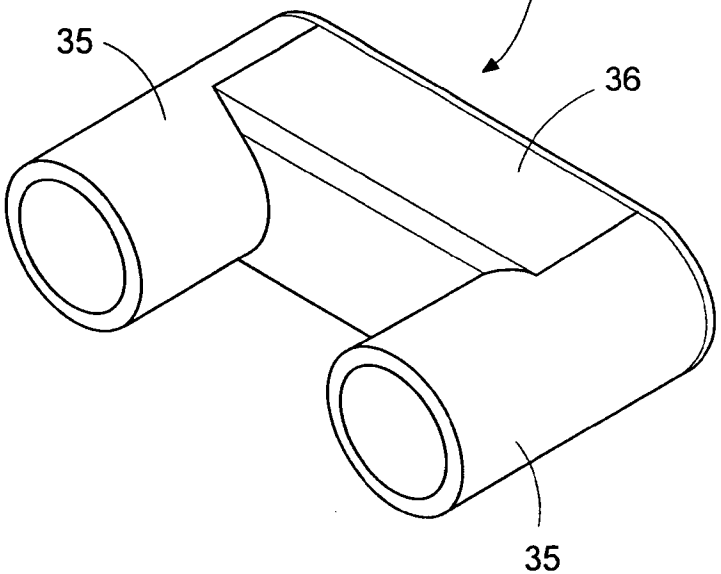
FIG. 8 illustrates a perspective view of a wire connector connecting a pair of lighting fixtures in series in accordance with the invention.

Referring to FIGS. 8 and 9, the wire connector 34 for electrically joining two tubes 10 together side-by-side has a pair of parallel tubular protrusions 35 extending from a common hollow housing 36. Each protrusion 35 is sized to slidably fit within an opening 31 in the end cap 27 of a tube 10. One protrusion 35 houses a male connector (not shown) while the other protrusion 35 houses a female connector (not shown) that are electrically linked internally and are insertable into the end caps 27 of the tubes 10. A like wire connector (not shown) can be positioned on the opposite ends of the pair of tubes 10.

Figure 7:
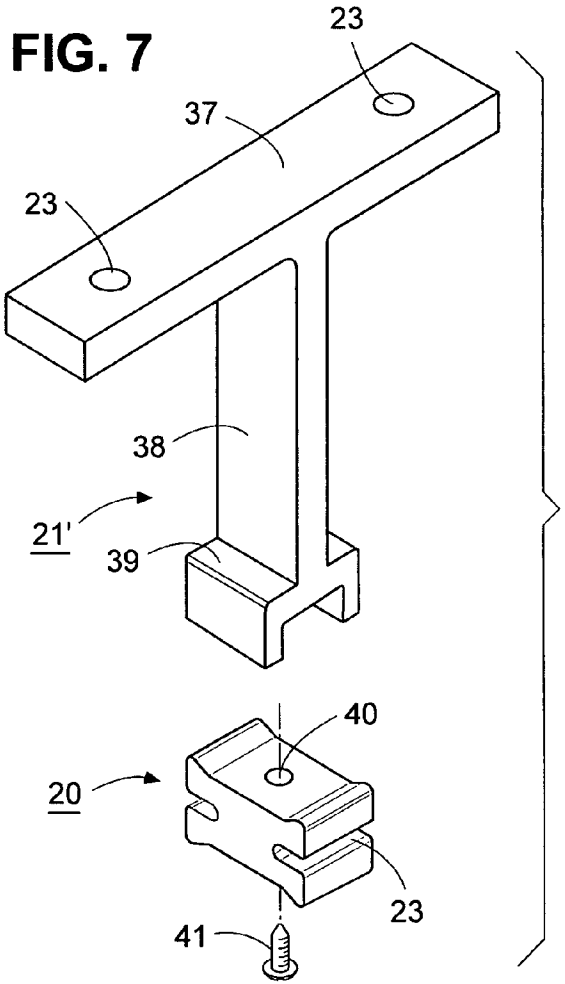
FIG. 7 illustrates a perspective view of a modified mounting bracket in accordance with the invention.

Referring to FIG. 7, wherein like reference characters indicate like parts as above, the mounting bracket 21' may be modified for hanging a pair of fixtures. In this respect, the mounting bracket 21' has a flange 37 and a web 38 defining a T-shaped cross-section with a U-shaped base 39 at the end of the web 38 opposite the flange 37. The base 39 is sized to receive a connector 20 transversely thereof. In addition, the connector 20 is provided with a through bore 40 and the base 39 is provided with an internally threaded bore (not shown) to receive a mounting screw 41 whereby the connector 20 is secured to the mounting bracket 21'.

Since each tube 10 has its own "driver" built in and contains male connectors on one end and female ones on the other end to permit "daisy chaining", the far lower power consumption of LED's as compared to fluorescents will more easily permit feed-through wiring of this type. The need for differing ballasts and complex wiring is eliminated.

An alternate configuration that is permitted by the aforementioned construction is to assemble the tubes 10 in a linear manner for long straight runs, using short connecting cables or a molded male/female jumper to connect each end.

An advantageous aspect of the construction is the modularity that is possible. Since the tube 10 can be extruded, the tube 10 can be provided in long lengths, e.g. 12 or 20 feet long. If the illumination PC board were made in, e.g., 12" or 24" inch lengths and the power supply (driver, in LCD illumination terms-actually a DC power supply) were made either in different power ratings, or if economically more feasible, made as one capable of powering 4 or 8 of the 12" luminary units, then all the sub-assemblies could be kept in stock until an order is received for, e.g., a 1 ft, 2 ft, 3 ft, 4 ft or 8 ft unit (all common sizes in the fluorescent field). The extruded sections could be cut to the required length, and a sufficient number of illuminating LED PC boards connected together, end to end, to suit the length of fixture required, and a sufficiently sized driver to power the fixture.

Thus, there would be no completed units in stock, some of which may be slow sellers. Only sub-assemblies common to all varieties would need to be stocked thereby reducing inventory investment.

The invention thus provides an improved construction of an LED tube that can stand alone without a fixture and that is adaptable to many varied types of mounting configurations. Further, the invention provides for the ganging together of a plurality of LED tubes either width-wise or length-wise to give more light.

The invention also provides a tube that can be provided with a plug and socket connection to a supply mains for easy installation and replacement.

What is claimed is:

1. In combination a tube having a transparent peripheral portion, a first pair of internally disposed longitudinally extending slots integrally formed inside said transparent portion, an opaque portion having a flat surface and a second pair of internally disposed longitudinally extending slots therein, and a pair of externally disposed longitudinally extending slots;

an LED array board mounted in said first pair of internally disposed slots and disposed across said tube in opposition to said transparent portion;

at least one pair of connectors, each said connector being slidably mounted in a respective one of said externally disposed slots of said tube; and at least one pair of mounting brackets, each said mounting bracket being secured to a respective one of said pair of connectors,

2. In combination a tube having a transparent peripheral portion, a pair of internally disposed longitudinally extending grooves and a pair of externally disposed longitudinally extending slots;

an LED array board mounted in said internally disposed grooves and disposed across said tube in opposition to said transparent portion:

at least one pair of connectors, each said connector being slidably mounted in a respective one of said externally disposed grooves of said tube; and at least one pair of mounting brackets, each said mounting bracket being secured to a respective one of said pair of connectors, wherein each said connector has an exterior shape at one side for mating in a respective one of said externally disposed slots of said tube and an exterior shape at an opposite side for matingly receiving a respective one of said pair of mounting brackets thereon.

3. the combination as set forth in claim 2 wherein each said connector has a slot in each of said one side and said opposite side to impact a degree of elasticity to each of said one side and said opposite side.

4. In combination a tube having a transparent peripheral portion, a pair of internally disposed longitudinally extending grooves and a pair of externally disposed longitudinally extending slots;

an LED array board mounted in said internally disposed grooves and disposed across said tube in opposition to said transparent portion;

at least one pair of connectors, each said connector being slidably mounted in a respective one of said externally disposed grooves of said tube; and at least one pair of mounting brackets each said mounting bracket being secured to a respective one of said pair of connectors and having a dove-tailed groove for matingly receiving a respective one of said pair of connectors therein.

5. In combination a tube having a transparent peripheral portion, a pair of internally disposed longitudinally extending grooves and a pair of externally disposed longitudinally extending slots;

an LED array board mounted in said internally disposed grooves and disposed across said tube in opposition to said transparent portion;

at least one pair of connectors, each said connector being slidably mounted in a respective one of said externally disposed grooves of said tube;

at least one pair of mounting brackets, each said mounting bracket being secured to a respective one of said pair of connectors; and a pair of end caps, each said end cap being mounted on a respective end of said tube and having a pair of cut-outs in coaxial alignment with said pair of externally disposed grooves in said tube.

6. The combination as set forth in claim 4 wherein at least one of said pair of ends caps has a central opening therein.

7. An LED tube comprising a transparent peripheral portion, a first pair of internally disposed longitudinally extending slots for receiving an LED array board opposite said transparent portion, a pair of externally disposed longitudinally extending slots, an opaque portion integral with said transparent portion and forming a self-supporting tubular body therewith, and a second pair of internally disposed longitudinally extending slots in said opaque portion for receiving a circuit board having a driver circuit.

* * * * *